US008475343B2

(12) United States Patent
Hinds et al.

(10) Patent No.: US 8,475,343 B2
(45) Date of Patent: Jul. 2, 2013

(54) PUSH-UP / CHIN-UP EXERCISE ASSEMBLY

(75) Inventors: Robert S. Hinds, Madison, WI (US); Glenn Polinsky, Waunakee, WI (US); Ray Rollins, Verona, WI (US); John Stephenson, Madison, WI (US); William Sotis, Fitchburg, WI (US)

(73) Assignee: Robert S. Hinds, Madison, WI (US)

( * ) Notice: Subject to any disclaimer, the term of this patent is extended or adjusted under 35 U.S.C. 154(b) by 53 days.

(21) Appl. No.: 12/634,884

(22) Filed: Dec. 10, 2009

(65) Prior Publication Data

US 2010/0144502 A1 Jun. 10, 2010

Related U.S. Application Data

(60) Provisional application No. 61/121,305, filed on Dec. 10, 2008.

(51) Int. Cl.

| | |
|---|---|
| ***A63B 23/12*** | (2006.01) |
| ***A63B 21/068*** | (2006.01) |
| ***A63B 21/08*** | (2006.01) |

(52) U.S. Cl.

USPC ..... 482/96; 482/49; 482/139; 482/141

(58) Field of Classification Search

USPC ..... 482/44, 45, 49, 139, 141, 143–144, 482/910, 19, 38–40, 91, 96; 211/119.004; D21/665, 684; 16/421–422, DIG. 1, DIG. 24

See application file for complete search history.

(56) References Cited

U.S. PATENT DOCUMENTS

| | | | | |
|---|---|---|---|---|
| 2,214,052 | A * | 9/1940 | Good | 482/105 |
| 3,427,023 | A * | 2/1969 | Silberman | 482/139 |
| 4,419,990 | A | 12/1983 | Forster | |
| 4,610,448 | A * | 9/1986 | Hill | 482/141 |
| 4,768,778 | A | 9/1988 | Thomas, Jr. | |
| 4,941,496 | A * | 7/1990 | Berning | 135/67 |
| 5,226,868 | A * | 7/1993 | Montgomery | 482/141 |
| 5,358,463 | A | 10/1994 | Fuentes | |
| 5,460,279 | A * | 10/1995 | Emery et al. | 211/106 |
| 5,632,707 | A | 5/1997 | Daniel et al. | |
| 6,412,647 | B1 * | 7/2002 | Ko | 211/106 |
| 6,503,175 | B1 | 1/2003 | Harrell | |
| 7,318,793 | B2 | 1/2008 | Dubrul et al. | |
| 7,377,888 | B2 | 5/2008 | Godbold | |
| 7,468,025 | B2 * | 12/2008 | Hauser et al. | 482/141 |
| 7,481,753 | B2 | 1/2009 | James et al. | |
| 7,503,884 | B1 * | 3/2009 | Schall | 482/141 |
| 7,601,100 | B1 | 10/2009 | Hinds et al. | |

(Continued)

*Primary Examiner* — Loan Thanh
*Assistant Examiner* — Sundhara Ganesan
(74) *Attorney, Agent, or Firm* — Craig A. Fleschko, Esq.; DeWitt Ross & Stevens S.C.

(57) ABSTRACT

An exercise assembly includes an exercise handle with a grip base suitable for resting on a floor, and a grip elevated above the grip base. A user can situate the grip bases of a pair of the exercise handles on the floor, grasp their grips, and then perform push-ups. The grip bases can also be mounted to the top of a door or to other overhead structure, and the user can then grasp their grips to perform chin-ups. Preferably, this is done by providing a cradle which mounts to the door or other overhead structure, wherein the exercise handles may be firmly (but removably) nested into the cradles to mount them to the structure. The exercise handles may also bear passages or attachments for receiving elastic (or inelastic) cables for use in performing further exercises.

23 Claims, 3 Drawing Sheets

U.S. PATENT DOCUMENTS

2004/0007549 A1* 1/2004 Klein et al. ..... 211/118
2004/0266593 A1 12/2004 Schwendeman
2006/0014615 A1 1/2006 Godbold
2006/0035771 A1* 2/2006 Gant ..... 482/141

* cited by examiner

PUSH-UP / CHIN-UP EXERCISE ASSEMBLY

CROSS-REFERENCE TO RELATED APPLICATIONS

This application claims priority under 35 USC §119(e) to U.S. Provisional Patent Application No. 61/121,305 filed 10 Dec. 2008, the entirety of which is incorporated by reference herein.

FIELD OF THE INVENTION

This document concerns an invention relating generally to exercise devices, and more specifically to devices which assist with the performance of push-ups and/or chin-ups.

BACKGROUND OF THE INVENTION

A push-up is a common strength training exercise wherein the person exercising lies face down in a horizontal position, and then pushes against the floor with his/her arms to raise his/her body, followed by relaxation of the arms to lower his/her body. Push-ups are popular because they do not require equipment, and can be performed nearly anywhere. However, in recent years, push-up handles have come into common use: handles which may be grasped by users while performing push-ups, and which extend downwardly to enlarged bases which rest on the floor. Such handles can provide more comfort to a user's hands/wrists while performing push-ups, and since they space the user' s hands from the floor, the user may (when relaxing his/her arms) drop his/her chest and face to a height at or below the height of his/her palms. In contrast, without push-up handles, the user's range of motion is more limited since the user naturally cannot move his/her chest and face past the floor.

Chin-ups (or pull-ups) are also common strength training exercises where the person exercising grasps an overhead bar or other overhead member, and then pulls his/her body up until the bar approaches or touches the upper chest, followed by relaxation of his/her arms until they're straight. Chin-ups are also popular owing to their simplicity and low expense, though they are limited by their requirement for an easily graspable overhead structure (and for sufficient clearance above the structure). In recent years, door-mounted chin-up bars have become popular, wherein bars are mountable to doors or doorframes at heights allowing users to perform chin-ups with the bars.

A common complaint in the exercise field is that is generally expensive and space-consuming for one to obtain all of the equipment needed for one to completely exercise his/her entire body, or even his/her main muscle groups. Taking push-ups and chin-ups as examples, users must purchase and store both exercise handles and chin-up bars if they wish to gain the benefits of these devices. It would be useful to have more available options for decreasing the bulk and cost of these devices.

SUMMARY OF THE INVENTION

The invention involves exercise assemblies which are intended to at least partially solve the aforementioned problems. To give the reader a basic understanding of some of the advantageous forms and features of the invention, following is a brief summary of preferred versions of the exercise assembly, with reference being made to the accompanying drawings (which are briefly reviewed in the following "Brief Description of the Drawings" section of this document) to assist the reader's understanding. Since the following discussion is merely a summary, it should be understood that more details regarding the preferred versions may be found in the Detailed Description set forth elsewhere in this document. The claims set forth at the end of this document then define the various versions of the invention in which exclusive rights are secured.

Looking to FIGS. 1-5 for various views of a preferred version of the exercise assembly—and in particular comparing FIGS. 1-2 with FIGS. 3-5—the exercise assembly includes an exercise handle 100 and a cradle 200. When two exercise handles 100 are provided (see particularly FIGS. 1 and 2), a user may hold one in each of his/her hands when performing push-ups, such that the exercise handles 100 provide the user with a comfortable grip, and with greater spacing between the user's hands and the floor (such that the user, when lowering his/her body, does not have his/her face approach the floor as closely). Each exercise handle 100 may be provided in conjunction with a cradle 200 which is configured to removably receive a handle 100 therein (see FIGS. 3-5), and which is mountable to surrounding environment such as the top of a door, such that a user can then perform chin-ups by use of the exercise handles 100 situated within the mounted cradles 200. The exercise handle 100 and cradle 200 will now be discussed in turn.

The exercise handle 100 includes a grip base 102 with a grip base upper section 104, an opposing grip base lower section 106 (see FIG. 2), and a grip base side perimeter 108 extending between the grip base lower section 106 and the grip base upper section 104. The grip base side perimeter 108 can be regarded as including opposing inner and outer grip base sides 110 and 112, and opposing right and left grip base sides 114 and 116 extending between the inner and outer grip base sides 110 and 112. A pair of spaced grip support struts 118 extend from the grip base 102, preferably from the grip base upper section 104 at or near the right and left grip base sides 114 and 116, and also from a location closer to the outer grip base side 112 than the inner grip base side 110. A grip 120 then extends between the grip support struts 118 so that it is spaced from the grip base upper section 104. Thus, a user may situate the grip base lower section 106 against a floor, and may grasp the grip 120 to perform push-ups in the manner described above with respect to prior push-up handles.

The grip support struts 118 preferably have lengths bending over the grip base upper section 104 toward the inner grip base side 110, with the grip support struts 118 defining a grip mouth 122 between the grip base 102, the grip support struts 118, and the grip 120. This grip mouth 122 is open from the inner grip base side 110 (i.e., between the grip support struts 118 and the inner grip base side 110) and between the right and left grip base sides 114 and 116. As a result, the grip base 102, the grip support struts 118, and the grip 120 have a hook-like shape wherein the grip mouth 122 defines the mouth of the hook, whereby hanging structure on a door or other portions of the surrounding environment can be received within the grip mouth 122 to suspend the exercise handle 100 above the floor in the orientation shown in FIGS. 1-5. The grip 120 is preferably situated to extend between the grip support struts 118 along an axis located at or near a plane situated halfway between the opposing inner and outer grip base sides 110 and 112, so that the grip 120 is centrally located on the exercise handle 100, thereby making the exercise handle 100 resistant to tipping when it is used for push-ups. At the same time, the bent/curving orientation of the grip support struts 118 allows more free space for the user in the direction of the inner grip base side 110: when the inner grip base side 110 faces toward the user's body, the grip support struts 118 are well clear of the path of travel of the user's wrists/forearms during push-ups, even where the grips 120 are oriented nearly perpendicular to the user's body.

Optionally, the grip base lower section 106 (seen in FIG. 2) may be rotatable with respect to the grip base upper section 104 about an axis of rotation, such that the grip base upper section 104 can pivot with respect to the grip base lower section 106 (and the floor) when a user performs push-ups. The grip base upper and lower sections 104 and 106 are also preferably lockable with respect to each other to prevent their relative rotation when desired. A preferred way of providing such lockability is shown in FIG. 6, which shows the exercise handle 100 bisected between its right and left grip base sides 114 and 116. The grip base upper section 104 is shown with an annular upper bearing race 124 which is rotatably engaged to an annular lower bearing race 126 on the grip base lower section 106, allowing the grip base upper section 104 to rotate with respect to the grip base lower section 106. The grip base lower section 106 includes a series of protruding members 128 arrayed about the axis of rotation. The grip base upper section 104 then includes a rotatable member 130 (also seen well in FIG. 5) wherein selective rotation of the rotatable member 130 situates at least a portion of the rotatable member 130—e.g., the descending annular wall 132, which only extends about a portion of the circumference of the rotatable member 130 (e.g., 180 degrees)—within a path of travel of the protruding members 128 when the grip base lower section 106 rotates with respect to the grip base upper section 104. As a result, the rotatable member 130 can be rotated to selectively interfere with the travel of the protruding members 128, and thereby hinder rotation of the grip base lower section 106 with respect to the grip base upper section 104.

As seen (for example) in FIG. 1-4, a grip passage 134 extends within the grip 120 between opposing grip passage openings (also depicted at 134), whereby a flexible elongated member (e.g., a strap or elastic cable) may be inserted to extend through the grip passage and out the grip passage openings 134. Such elongated members can be put to a variety of uses, as discussed in greater detail below. As one example, an elastic cable can be inserted through the grip passages 134 of a pair of exercise handles 100, and its ends can then be fastened together to form a loop having a length strung through the exercise handles 100. A user can then perform push-ups with the elastic cable situated behind his/her back, with the cable thereby increasing the resistance experienced by the user.

The cradle 200—best seen in FIG. 1—includes a cradle base 202 extending between a cradle base top 204 and a cradle base bottom 206, and a pair of spaced cradle arms 208 extending from the cradle base 202, with the cradle arms 208 being shown joined by a cradle grip base support 210 situated therebetween. The cradle 200 preferably offers one or more of the following points of support for the exercise handle 100. First, the cradle arms 208 may define or bear cradle hooks 212 configured to receive and support at least one of the grip 120 and the grip support struts 118 when the exercise handle 100 is fully engaged within the cradle 200. Second, the cradle arms 208 may define or bear cradle grip supports 214 which can be received within the grip mouth 122 defined between the grip base 102, the grip support struts 118, and the grip 120, such that the grip support struts 118 extend about the cradle grip supports 214 with the grip base 102 situated between the cradle grip supports 118 and the cradle base 202. Third, the cradle 200 may include a grip base pocket 216 defined therein (here in the cradle grip base support 210), wherein the grip base pocket 216 has a top entry 218 which opens in a direction toward the cradle base top 204, with the top entry 218 being sized to removably receive the grip base 102 of the exercise handle 100 therein. At the same time, the grip base pocket 216 is configured to prevent the grip base 102 from exiting the grip base pocket 216 in a direction toward the cradle base bottom 206 (here by having a size/width which decreases in a direction toward the cradle base bottom 206). The grip base 102 of the exercise handle 100 can therefore be inserted into the top entry 218 of the grip base pocket 216 to be supported therein.

As noted previously, the cradle 200 preferably includes means for mounting the cradle 200 to surrounding environment. In FIGS. 1-4, the mounting means is more specifically shown in the form of door mounting means for mounting the cradle 200 atop a door, with the door mounting means here taking the form of an extension 220 extending away from the exercise handle 100, and an anchor 222 situated on the extension 220 opposite the exercise handle 100. The extension 220 has a small cross-sectional area in a vertical dimension, whereby the extension 220 may fit within a space defined between a top of a door and a door frame surrounding the door. The anchor 222 then has a large cross-sectional area in the vertical dimension, whereby the anchor 222 may not fit within the space defined between the top of the door and the door frame surrounding the door. As a result, when the cradle 200 is situated next to the top of an open door, with the extension 220 resting atop the door and the anchor 222 resting on the opposite side of the door, the extension 220 and anchor 222 form a hook which holds the cradle 200 atop the door. Owing to the sandwiching of the anchor 222 between the door and frame, this hook is difficult to dislodge when the door is closed. When the exercise handle 100 is then received within the cradle 200, the grip 120 of the exercise handle 100 is supported within the cradle 200 in an at least substantially horizontal orientation, with an unobstructed gripping space being defined about the length of the grip 120 so that a user may readily perform chin-ups by use of the cradled exercise handle 100.

Further advantages, features, and objects of the invention will be apparent from the remainder of this document in conjunction with the associated drawings.

DETAILED DESCRIPTION OF PREFERRED VERSIONS OF THE INVENTION

Figure 1:
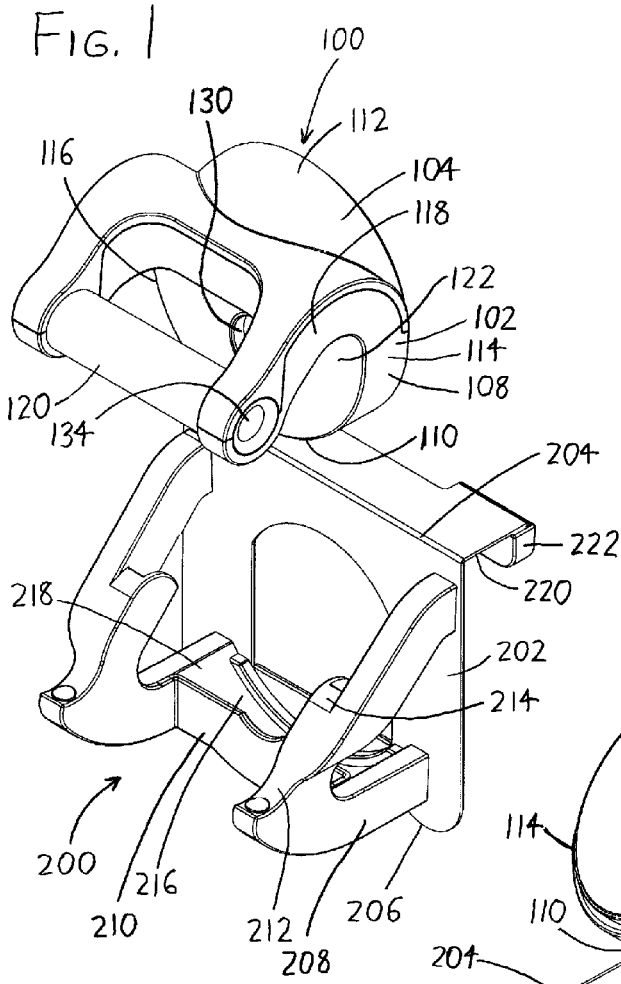
FIG. 1 is an exploded (disassembled) front perspective view showing the exercise handle 100 situated prior to insertion within the cradle 200 (and with the cradle 200 being shown in an orientation in which it might be situated atop a door or other structure).
Figure 2:
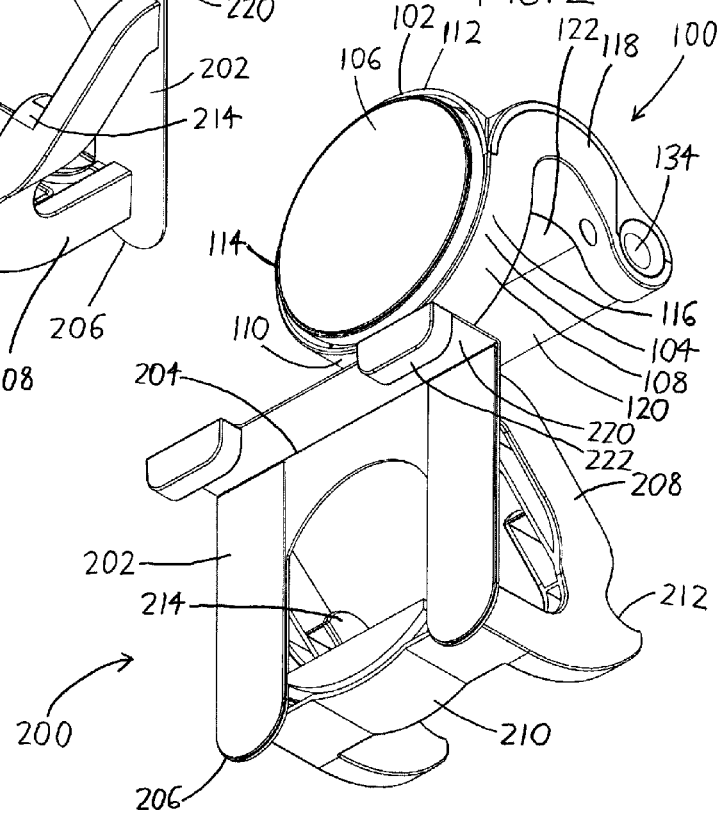
FIG. 2 is an unexploded rear perspective view corresponding to FIG. 1.
Figure 3:
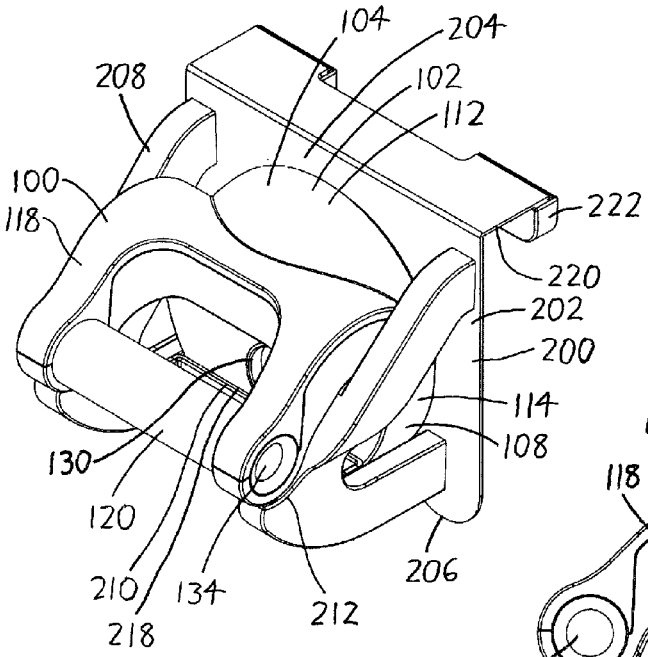
FIG. 3 is a perspective view corresponding to FIG. 1 wherein the exercise handle 100 is inserted within the cradle 200.
Figure 4:
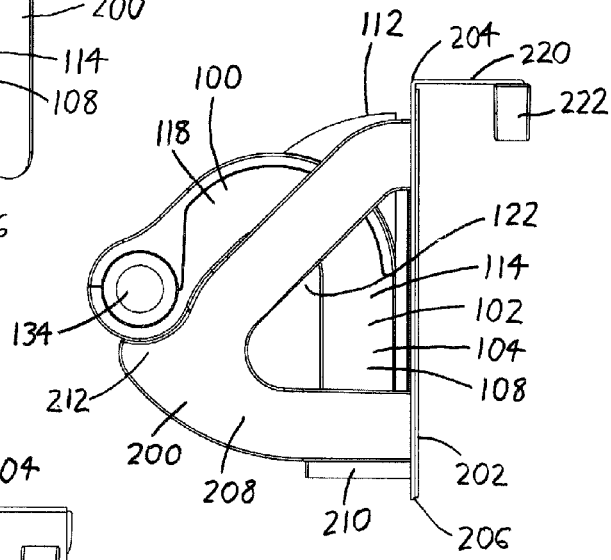
FIG. 4 is a side view of the arrangement of FIG. 3.
Figure 5:
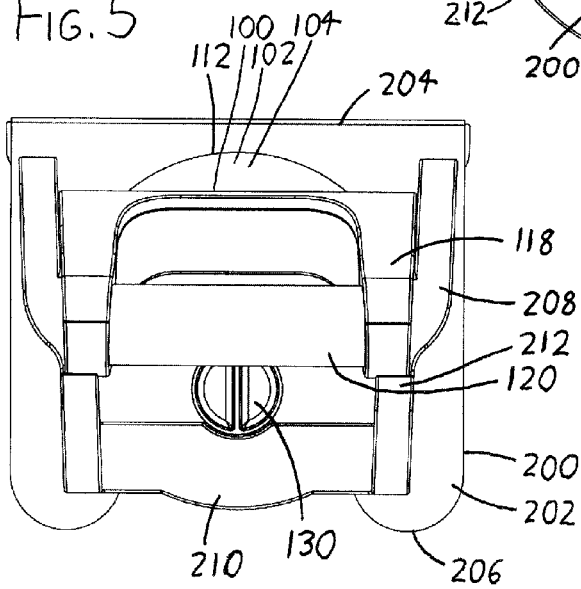
FIG. 5 is a front view of the arrangement of FIG. 3.
Figure 6:
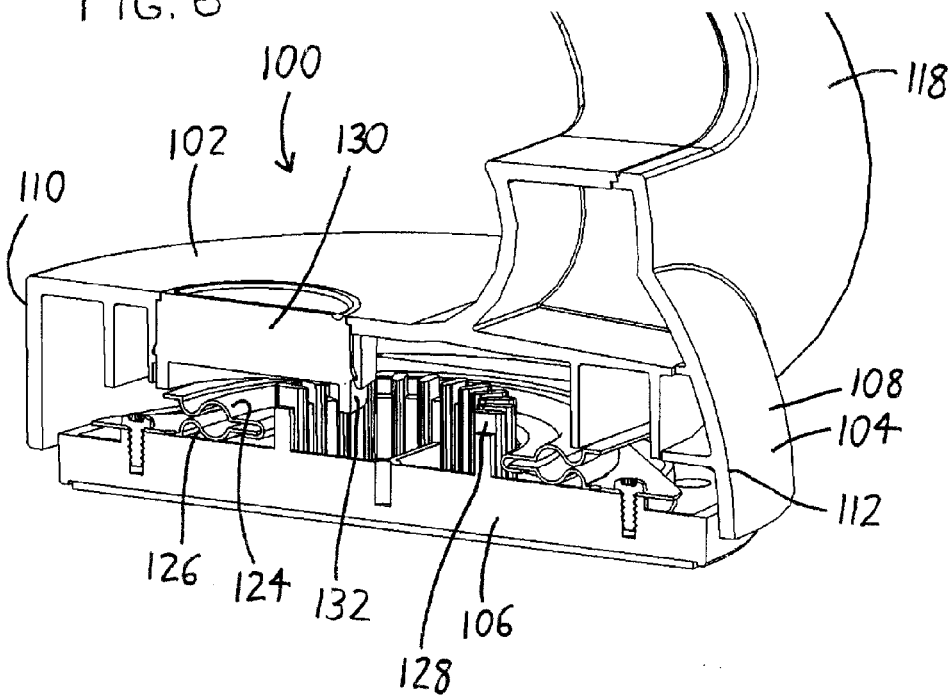
FIG. 6 is a view of a section of the exercise handle 100 of the preceding Figures, showing the handle 100 bisected along a plane situated between its right and left grip base sides 114 and 116.

Expanding on the discussion above, the mounting means for mounting the cradle 200 to surrounding environment—such as to a door—can assume a wide variety of forms other than those discussed above, such as fasteners (e.g., bolts which extend to surrounding environment such as a wall);

apertures for complementarily receiving structure situated on surrounding environment (e.g., hanging holes for receiving a hook or bolt head extending from surrounding environment such as a wall); clamps for engaging doorframes, bars, or other structure which presents clamping surfaces; or hooks, clips, straps/cords, or other structure allowing the cradle 200 to be hooked, clipped, tied, or otherwise affixed to surrounding environment. Most preferably, the cradle 200 is mountable to a door, with the mounting means being specially configured to mount the cradle 200 atop a door. As noted previously, a preferred form of such a door mounting means includes an extension 220 which is configured to rest atop a door and fit within the space defined by the top of the door and the door frame when the door is closed, and an anchor 222 for fitting on the side of a door opposite the side where the cradle 200 is situated (with the anchor 222 being sized and/or configured such that it cannot slip between the space defined by the top of the door and the door frame when the door is closed). The extension 220 and anchor 222 can take forms other than those shown, e.g., the extension 220 could be a flexible strap or cord, and the anchor 222 could be a block, cylinder, or other member sized such that it cannot slip between the space defined by the top of the door and the door frame when the door is closed.

As briefly discussed above, the grip passage 134 extending within the grip 120 can usefully expand the capabilities of the exercise assembly by allowing installation of a variety of components within the grip passage 134, e.g., flexible (or inflexible) cords or straps, bars/rods, or other members that might be supported within the grip passage 134. The foregoing discussion mentioned the use of an elastic loop having a length of the loop extending through the grip passages 134 of a pair of exercise handles 100, and wherein the user can then perform push-ups with the elastic loop extending behind the user' s back to increase the resistance encountered when pushing away from the handles 100. In similar respects, the user can install such exercise handles 100 within a pair of cradles 200 mounted to a door (or to other structure) to perform chin-ups, with the user standing on a length of the loop while performing the chin-ups, so that the elastic cable acts to lift the user and thereby effectively reduces the resistance encountered by the user. As yet another example, the aforementioned loop can be extended from one or both exercise handles 100 situated within one or more cradles 200 at the top of a door, or at the bottom of a door, or on another structure, with the user sitting or standing spaced from the cradle(s) 200, and working against the resistance of the elastic member(s) with his/her arms and/or legs. All of the foregoing exercises may alternatively or additionally be performed with elastic members which are not looped, e.g., straight lengths of elastic cable, strap, or the like, with their lengths extending through the grip passage 134, and possibly bearing bands/handles at the ends of the member(s). The reader is referred to U.S. Pat. No. 7,578,775 (as an example) for depictions of a number of exercises that might be performed using elastic cables extending from an anchored exercise handle 100, and also for depictions of a variety of cable arrangements and associated accessories that might be used with the exercise assembly.

It is also possible that the aforementioned components—cables, straps, bars, etc.—can fit in passages defined in an exercise handle 100 away from the grip 120, e.g., a passage might be defined within the grip base 102. Further, rather than mounting the aforementioned components in a passage extending between opposing passage openings, the components may engage within a closed-ended passage, or to an aperture or protrusion which engages such components. As an example, an elastic cable having an enlarged plug at one of its ends might be engaged within a complementarily-configured socket or nest defined somewhere on an exercise handle 100 (or on a cradle 200).

It is also notable that the grip passage 134 can be used to provide mounting means for the exercise handle 100, whereby the exercise handle 100 can be mounted to a door or other structure without the need for the cradle 200. To illustrate, an extension in the form of a flexible strap (as opposed to a rigid plate/flange 220) can extend through the grip passage 134, with the extension/strap bearing larger-diameter anchors (similar to anchors 222) at its ends on opposite sides of the length of the grip 120. The grip base lower section 106 can then be situated against a door near the door' s top, and the ends of the extension/strap may be extended over the door with the anchors resting on the side of the door opposite the exercise handle 100. When the door is then closed, the anchors can prevent the extension/strap from pulling through the door, thereby suspending the exercise handle 100 from the top of the door. If desired, the anchors could be replaced with hooks allowing mounting to an elevated bar, clamps for mounting to a doorframe or another structure, or other forms of mounting means.

Further, the exercise handle 100 may directly bear mounting means without the need for or use of the grip passages 134. For example, hooks, clamps, or other mounting means might be provided directly on the exercise handles 100 (e.g., on the grip base 102), preferably in such a manner that they may fold against and/or nest into the body of the exercise handle 100 when not in use. One or more extensions/straps and anchors might be mounted directly to the grip base 102 to allow mounting the exercise handle 100 to a door in a manner discussed above.

It should be understood that one or both of the exercise handle 100 and the cradle 200 may adopt configurations which are significantly different from those shown in the accompanying drawings. As an example, the exercise handle 100 may be configured to use only a single grip support strut 118, with the grip 120 being cantelevered over the grip base 102. The grip base upper and lower sections 104 and 106 need not rotate with respect to each other, and can (for example) be integrally formed together to simply define grip base upper and lower surfaces which are joined with respect to each other. The grip base lower section 106 need not have a planar surface for resting against the floor, and may instead bear legs or the like. The cradle 200 might be configured to use any combination of one or more cradle hooks 212, cradle grip supports 214, and grip base pockets 216 for engaging/supporting the exercise handle 100. The reader is referred to the provisional patent application noted at the outset of this document for depictions and discussions of a number of other exemplary variations of the exercise handle 100 and cradle 200 having different configurations.

It should also be understood that various terms referring to orientation and position are used throughout this document—e.g., "upper" (as in "grip base upper section") and "lower" (as in "grip base lower section"), "top" (as in "cradle base top") and "bottom" (as in "cradle base bottom"), "right" (as in "right grip base side") and "left" (as in "left grip base side"), "inner" (as in "inner grip base side") and "outer" (as in "outer grip base side")—are relative terms rather than absolute ones. In other words, it should be understood (for example) that the right grip base side 114 referred to above may in fact be located at the left side of the exercise handle 100, or at its top or bottom, depending on the overall orientation of the assembly. Thus, such terms should be regarded as words of convenience, rather than limiting terms.

In summary, the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. An exercise assembly including an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides, wherein the distance between the inner and outer grip base sides is not substantially greater than the distance between the right and the left grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts.

2. The exercise assembly of claim 1 wherein each grip support strut extends from the grip base upper section from a location closer to the outer grip base side than the inner grip base side.

3. The exercise assembly of claim 1 wherein the grip extends between the grip support struts along an axis located at or near a plane situated halfway between the opposing inner and outer grip base sides.

4. The exercise assembly of claim 1 wherein a grip passage extends:

a. within the grip, and b. between opposing grip passage openings, with the grip being mounted between the grip support struts with the grip passage and grip passage openings being open, whereby an elongated member may be inserted to extend through the grip passage and out the grip passage openings.

5. The exercise assembly of claim 1 further including a cradle into which the exercise handle may be removably received along an insertion direction, the exercise handle being restrained from moving when received within the cradle except from motion in the direction opposite the insertion direction, wherein the cradle includes:

a. an extension extending away from the exercise handle when the exercise handle is received within the cradle, the extension having small cross-sectional area in a vertical dimension, whereby the extension may fit within a space defined by a top of a door and a door frame surrounding the door;

b. an anchor situated on the extension opposite the exercise handle when the exercise handle is received within the cradle, the anchor having large cross-sectional area in the vertical dimension, whereby the anchor may not fit within a space defined by a top of a door and a door frame surrounding the door;

whereby the exercise handle may be mounted within the cradle on a door, with the exercise handle being situated on one side of a door, the extension resting atop the door, and the anchor resting on the opposite side of the door.

6. The exercise assembly of claim 1 wherein a grip mouth is defined between:

a. the grip base upper section, b. the grip support struts, and c. the grip, the grip mouth being open:

(1) from the inner grip base side, and (2) from the right and left grip base sides as viewed along an axis parallel to the axis of the grip.

7. The exercise assembly of claim 6 further including a cradle having:

a. a cradle base, b. a cradle grip support affixed to and spaced from the cradle base, wherein the exercise handle may be supported on the cradle with:

(1) the cradle grip support received within the grip mouth, and (2) the grip base situated between the cradle grip support and the cradle base, with the cradle restraining the exercise handle from shifting with respect to the cradle.

8. The exercise assembly of claim 1 further including a cradle having:

a. a cradle top, b. an opposing cradle bottom, c. a grip base pocket defined therein, wherein the grip base pocket:

(1) has a top entry opening in a direction toward the cradle top, the top entry being sized to removably receive the grip base therein, (2) is configured to prevent the grip base from exiting the grip base pocket in a direction toward the cradle bottom, whereby the grip base is restrained against motion with respect to the grip base pocket except in a direction opposite the direction in which the grip base was received within the grip base pocket, d. mounting means for mounting the cradle to surrounding environment.

9. The exercise assembly of claim 1 wherein the grip is nonremovably affixed between the grip support struts.

10. An exercise assembly including an exercise handle having:

a. a grip base with:

(1) a grip base lower section which:

(a) is rotatable with respect to the grip base upper section about an axis of rotation, and (b) includes a series of protruding members arrayed about the axis of rotation;

(2) an opposing grip base upper section including a rotatable member wherein rotation of the rotatable member selectively situates at least a portion of the rotatable member within a path of travel of the protruding members when the grip base lower section rotates with respect to the grip base upper section, whereby the rotatable member can be rotated to selectively interfere with the travel of the protruding members and thereby hinder rotation of the grip base lower section with respect to the grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section;

c. a grip extending between the grip support struts adjacent to, but spaced from, the grip base upper section.

11. An exercise assembly including:

I. an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts;

II. door mounting means for restraining the exercise handle in a fixed position atop a door with the grip support struts extending away from the door to space the grip therefrom, whereby a user can grasp the grip and perform a chin-up therefrom without shifting of the exercise handle.

12. The exercise assembly of claim 11 wherein the door mounting means are provided on a cradle into which the exercise handle is removably received with the cradle closely interfitting the exercise handle, such that the exercise handle cannot substantially move within the cradle except for in the direction in which the exercise handle was received within the cradle.

13. An exercise assembly including:

I. an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts;

II. an extension extending away from the exercise handle, the extension having:

a. small cross-sectional area in a vertical dimension, whereby the extension may fit within a space defined by a top of a door and a door frame surrounding the door;

b. an anchor situated on the extension opposite the exercise handle, the anchor having large cross-sectional area in the vertical dimension, whereby the anchor may not fit within a space defined by a top of a door and a door frame surrounding the door;

wherein the extension is provided on a cradle into which the exercise handle is removably received, the cradle restraining the exercise handle against motion of the grip when a user performs a chin-up therefrom.

14. An exercise assembly including:

a. an exercise handle having:

(1) a grip base with:

(a) a grip base lower section, (b) an opposing grip base upper section, (c) a grip base side perimeter extending between the grip base lower section and the grip base upper section, the grip base side perimeter including:

i. opposing inner and outer grip base sides, and ii. opposing right and left grip base sides extending between the inner and outer grip base sides;

(2) a pair of spaced grip support struts extending from the grip base upper section;

(3) a grip extending between the grip support struts adjacent to, but spaced from, the grip base upper section, (4) a grip mouth defined between:

(a) the grip base upper section, (b) the grip support struts, and (c) the grip, the grip mouth being open:

i. from the inner grip base side, and ii. from the right and left grip base sides;

b. a cradle having:

(1) a cradle base, (2) a cradle grip support affixed to and spaced from the cradle base, (3) a cradle hook extending from the cradle base, the cradle hook being configured to receive and support at least one of:

a. (a) the grip, and b. (b) the grip support struts, therein when the exercise handle is supported on the cradle with:

(1) i. the cradle grip support received within the grip mouth, and (2) ii. the grip base situated between the cradle grip support and the cradle base.

15. An exercise assembly including:

I. an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts;

II. a cradle configured to receive the exercise handle therein, the cradle including door mounting means thereon for mounting the cradle atop a door, wherein the grip is restrained in an at least substantially horizontal orientation with the length of the grip having an unobstructed gripping space defined thereabout when:

a. the exercise handle is received within the cradle, and b. the cradle is mounted atop the door via the door mounting means.

16. An exercise assembly including:

I. an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts;

II. a cradle having:

a. a cradle base extending between a cradle base top and a cradle base bottom, b. a pair of spaced cradle hooks extending from the cradle base, the cradle hooks being configured to receive and restrain at least one of:

(1) the grip, and (2) the grip support struts, therein against motion other than in the direction of reception.

17. An exercise assembly including:

I. an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts;

II. a cradle having:

a. a cradle base extending between a cradle base top and a cradle base bottom, b. a grip base pocket which:

(1) opens in a direction toward the cradle base top, and (2) has decreasing size in a direction toward the cradle base bottom, whereby the grip base is insertable within the grip base pocket to be snugly restrained therein against motion other than in the direction of insertion.

18. An exercise assembly including an exercise handle having:

a. a grip base with:

(1) opposing right and left grip base sides, and (2) opposing inner and outer grip base sides extending therebetween;

wherein the distance between the inner and outer grip base sides is not substantially greater than the distance between the right and left grip base sides;

b. a pair of spaced grip support struts extending from the grip base at or near the right and left grip base sides;

c. a grip spaced from the grip base and extending between the grip support struts, wherein the grip support struts are bent along parallel spaced right and left planes to define a grip mouth between the grip base, the grip support struts, and the grip, the grip mouth being open from the inner grip base side and between the right and left grip base sides.

19. The exercise assembly of claim 18 wherein the grip support struts are:

a. laterally opposite each other along a lateral axis where the grip support struts extend from the grip base, and b. bent away from a lateral plane which:

(1) intersects the lateral axis, and (2) extends upwardly from a bottom side of the grip base.

20. The exercise assembly of claim 18 wherein the grip is nonremovably affixed between the grip support struts.

21. An exercise assembly including:

a. an exercise handle having:

(1) a grip base with:

(a) opposing right and left grip base sides, and (b) opposing inner and outer grip base sides extending therebetween;

(2) a pair of spaced grip support struts extending from the grip base at or near the right and left grip base sides;

(3) a grip spaced from the grip base and extending between the grip support struts, wherein the grip support struts are bent to define a grip mouth between the grip base, the grip support struts, and the grip, the grip mouth being open from the inner grip base side and between the right and left grip base sides;

b. a cradle having:

(1) a cradle base, (2) a cradle grip support affixed to and spaced from the cradle base, wherein the grip may be fixed within the cradle with:

(a) the cradle grip support received within the grip mouth, and (b) the grip base situated between the cradle grip support and the cradle base, such that a user can perform chin-ups by use of the grip.

22. The exercise assembly of claim 21 wherein the cradle further includes a cradle hook extending from the cradle base, the cradle hook being configured to receive and support at least one of:

a. the grip, and b. the grip support struts, therein when the grip is supported on the cradle with:

(1) the cradle grip support received within the grip mouth, and (2) the grip base situated between the cradle grip support and the cradle base.

23. An exercise assembly including an exercise handle having:

a. a grip base with:

(1) a grip base lower section, (2) an opposing grip base upper section, (3) a grip base side perimeter extending between the grip base lower section and the grip base upper section, the grip base side perimeter including:

(a) opposing inner and outer grip base sides, and (b) opposing right and left grip base sides extending between the inner and outer grip base sides;

b. a pair of spaced grip support struts extending from the grip base upper section, wherein each grip support strut:

(1) extends from the grip base upper section at or adjacent one of the right and left grip base sides, and (2) has a length extending:

(a) at least substantially along a plane coincident with one of the right and left grip base sides, and (b) along a path bending along the plane toward the inner grip base side;

c. a grip extending between the grip support struts:

(1) adjacent to, but spaced from, the grip base upper section, (2) along an axis intersecting, and oriented at least substantially perpendicularly to, the grip support struts, wherein the grip base lower section:

A. is rotatably mounted with respect to the grip base upper section, and

B. has greater cross-sectional area, as measured across a plane intersecting the grip base side perimeter, than any portion of the exercise handle situated above the grip base upper section, as measured across a parallel plane.

* * * * *